United States Patent [19]

Giebelhausen et al.

[11] Patent Number: 4,493,454

[45] Date of Patent: Jan. 15, 1985

[54] CASH COLLECTION RECEPTACLE

[75] Inventors: Charles W. Giebelhausen, Buffalo Grove; Jose E. Davila, Bourbonnais, both of Ill.

[73] Assignee: General Signal Corporation, Stamford, Conn.

[21] Appl. No.: 424,398

[22] Filed: Sep. 27, 1982

[51] Int. Cl.[3] ..... G07B 15/00

[52] U.S. Cl. ..... 232/15; 109/52; 109/70

[58] Field of Search ..... 109/45, 48, 52, 69, 109/70, 71; 232/7, 12, 15, 16, 43.2; 70/63; 220/210

[56] References Cited

U.S. PATENT DOCUMENTS

| | | | |
|---|---|---|---|
| Re. 28,307 | 1/1975 | Dominick et al. | 232/7 |
| Re. 28,308 | 1/1975 | Dominick et al. | 232/16 |
| 1,076,584 | 10/1913 | Kohler . | |
| 1,173,258 | 2/1916 | Gebhart | 232/7 |
| 3,670,955 | 6/1972 | Dominick et al. | 232/7 |
| 3,693,870 | 9/1972 | Dominick et al. | 232/16 |
| 3,733,863 | 5/1973 | Toepfer | 70/363 |
| 3,773,252 | 11/1973 | Jensen | 232/1 R |
| 3,807,628 | 4/1974 | Bock | 232/16 |
| 3,843,203 | 10/1974 | Golland et al. | 302/2 |
| 3,938,733 | 2/1976 | Weber et al. | 232/16 |
| 3,966,116 | 6/1976 | Dominick et al. | 232/7 |
| 4,201,333 | 5/1980 | Oslin et al. | 232/7 |
| 4,210,801 | 7/1980 | Gomez et al. | 235/92 |

FOREIGN PATENT DOCUMENTS

| | | | |
|---|---|---|---|
| 57930 | 12/1920 | Sweden | 232/15 |

*Primary Examiner*—Hugh R. Chamblee
*Assistant Examiner*—John G. Weiss
*Attorney, Agent, or Firm*—Allegretti, Newitt, Witcoff & McAndrews, Ltd.

[57] ABSTRACT

A cash collection receptacle for receiving coins and paper currency from a farebox is disclosed. The receptacle is comprised of a five-sided steel cashbox with two inner chambers which receive coins and currency separately from the farebox. The cashbox has disposed therein a lock assembly into which a slidable steel cover is engaged by means of a rotatable control handle to lock the cashbox.

11 Claims, 7 Drawing Figures

CASH COLLECTION RECEPTACLE

BACKGROUND OF THE INVENTION

The present invention relates to a cash collection receptacle for receiving currency and coins from a farebox and more particularly, to a cash collection receptacle comprising a cashbox having a slidable heavy duty cover which it fitted into a reinforced area at the top of the cashbox. The cashbox is slidably received by a cavity in the farebox and is locked to the farebox.

Fare passengers riding on public transport generally deposit cash and/or coins in collection cashboxes. The contents of the cashboxes must usually be moved to some centralized location for counting of receipts. Typical prior art fare collection apparatus and coin handling systems are described in Gomez et al., U.S. Pat. No. 4,210,801; Oslin et al., U.S. Pat. No. 4,201,333; Dominick et al., U.S. Pat. No. 3,966,116; Weber et al., U.S. Pat. No. 3,938,733; Golland et al., U.S. Pat. No. 3,843,203; Bock, U.S. Pat. No. 3,807,628; and Dominick et al., U.S. Pat. No. 3,693,870.

Fare collection still causes many problems for transit systems. Security measures must be taken to prevent pilferage and robbery. Separation of collected currency and coins generates significant expense. Consequently, cashboxes used by many transit systems, have a complicated construction, are difficult for operators, such as bus drivers, to use, and may not be sufficiently durable to withstand extensive use. From this background, the present invention was developed.

SUMMARY OF THE INVENTION

It is an object of the present invention to provide a cash collection receptacle having a simple and rugged design wherein simplicity is achieved by limiting movement to a single slidable cover for the receptacle, and wherein the receptacle is of a rugged construction with the working parts in the uppermost portion of the receptacle being constructed of steel.

A further object of the present invention is to provide a cash collection receptacle which has a cashbox with two chambers, one for maintaining coins and a separate one for maintaining paper currency thereby facilitating counting of the cash upon removal from the receptacle.

Still another object of the present invention is to provide a cash collection receptacle having a cashbox which is closed by a slidable, heavy duty cover that remains closed and locked when the receptacle is removed from a farebox.

In a preferred embodiment of the present invention, the cash collection receptacle is comprised of a cashbox having an open top. The cashbox is covered by a slidable cover which is pivotably attached to the cashbox and operated by a rotatable control handle which is also used to actuate the locking mechanism and to carry the cashbox.

These and other objects, advantages and features of the present invention will be set forth in the detailed description which follows.

BRIEF DESCRIPTION OF THE DRAWING

In the detailed description which follows, reference is made to the drawing comprised of the following figures.

and

Figure 7:
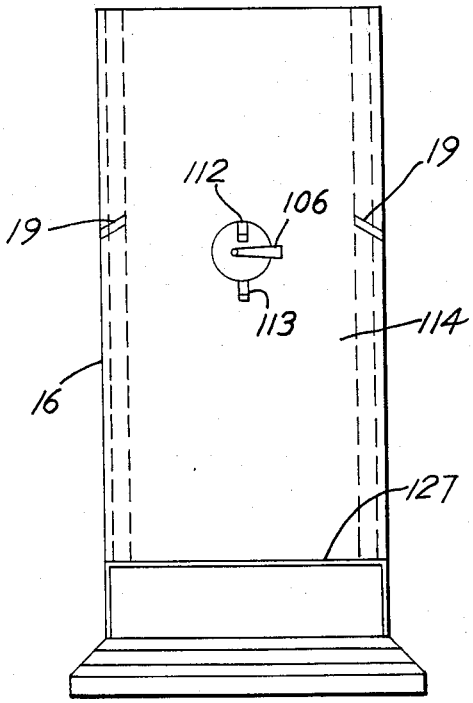

FIG. 7 is a front view of a farebox pedestal with which the cash collection receptacle of the present invention is used.

DETAILED DESCRIPTION OF THE PREFERRED EMBODIMENT

The figures illustrate the cash collection receptacle of the present invention. The receptacle includes a cashbox 10 having a pivotable cover 12. The cashbox 10 is received by an opening or cavity 14 in a farebox 16 so that currency and coins which are fed into the farebox 16 will pass into the cashbox 10. A lock mechanism retains the cashbox 10 locked in the opening 14 in the farebox 16. The lock mechanism (described below) may be operated to release the cashbox 10 to permit transport thereof to a central counting station or bank where the contents of the cashbox 10 are removed. The cashbox 10 has a bottom wall 18, opposed side walls 20, 22, a rear wall 24, and a front wall 26. The top of the cashbox 10 is open. Two heavy molded plastic bumpers 27 extend from wall 18 to absorb the impact when the cashbox 10 is dropped on its bottom surface.

Figure 3:
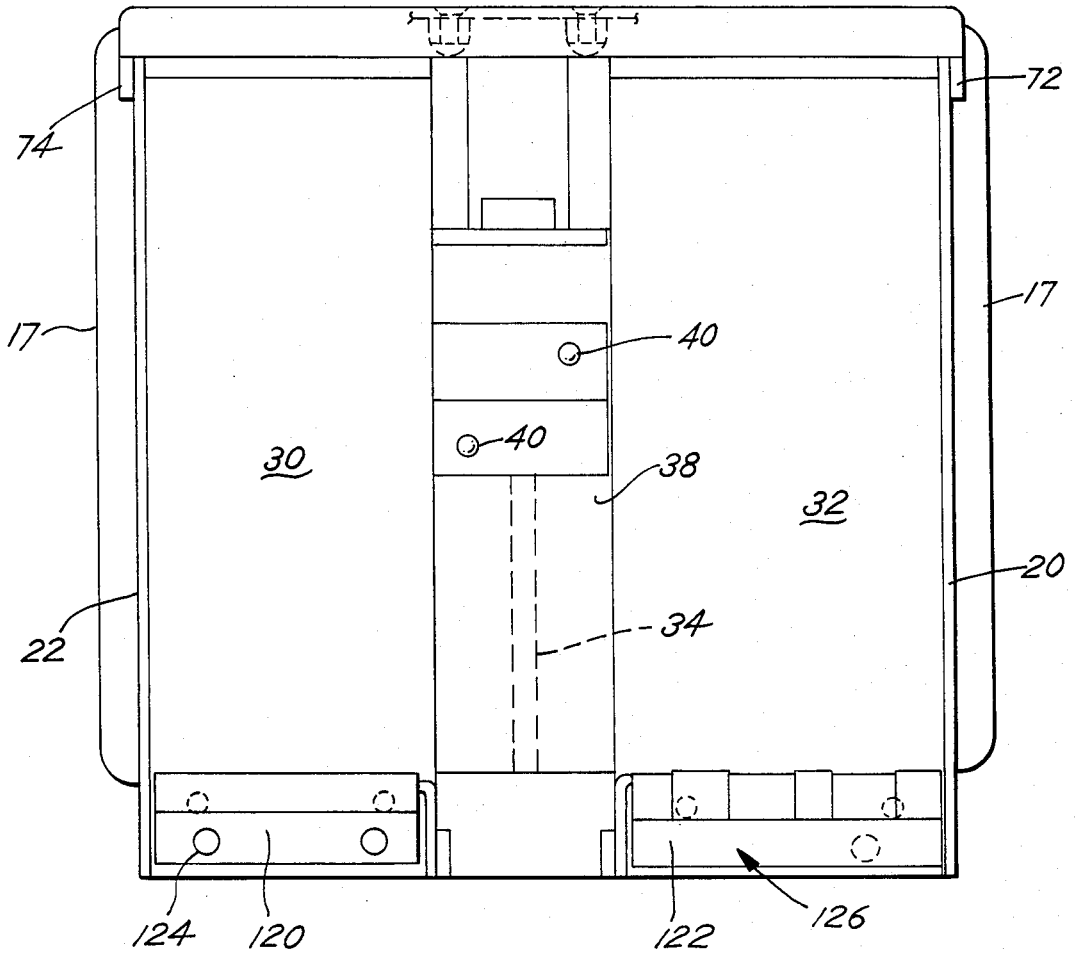
FIG. 3 is a top view of the interior of the cash collection receptacle.
Figure 4:
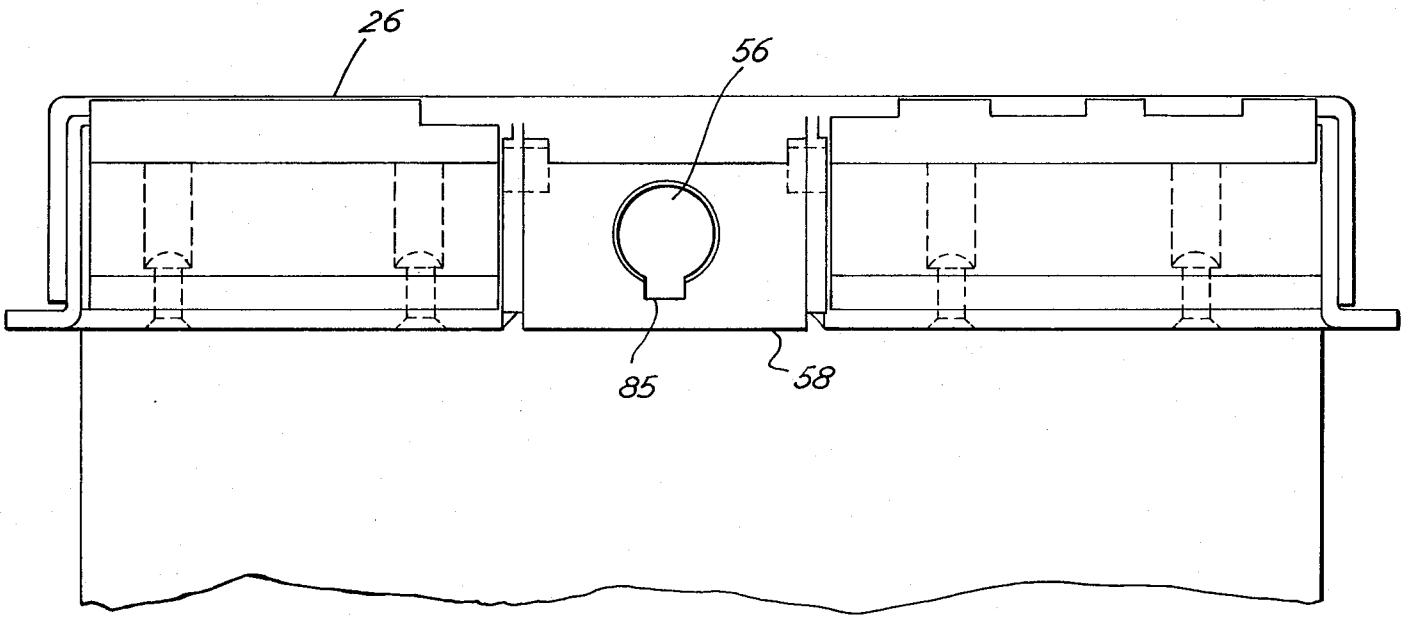
FIG. 4 is a partial side view of the cashbox illustrating the keyway through which the shaft of a control handle for the receptacle extends.
Figure 5:
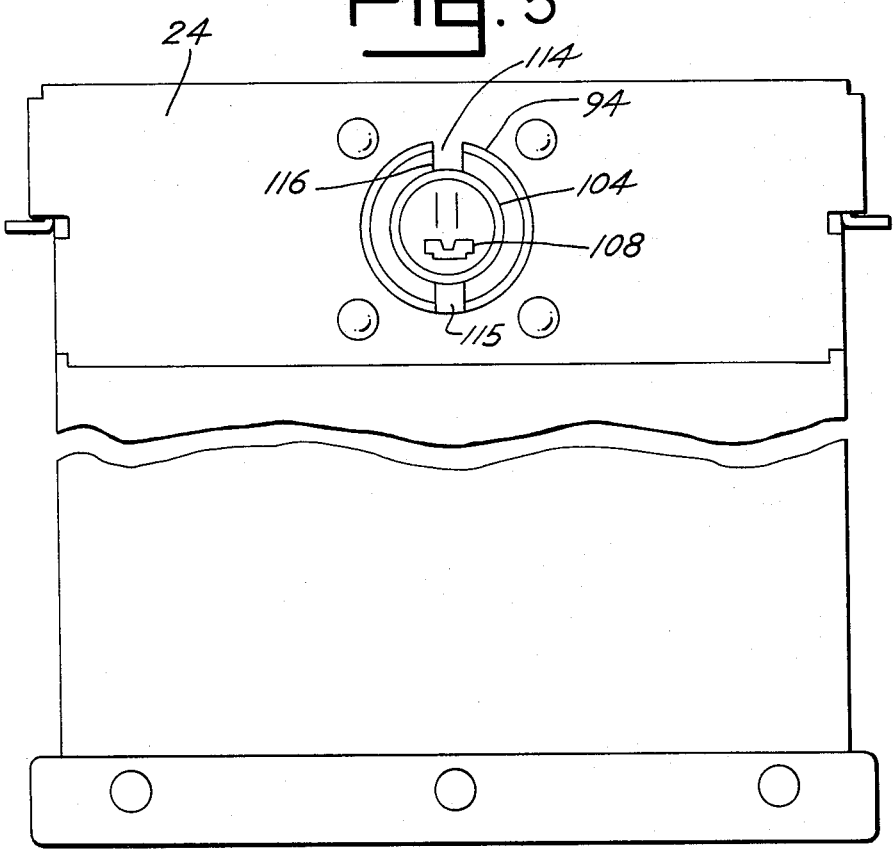
FIG. 5 is a back side view of the cash collection receptacle illustrating the rear portion of the lock assembly which cooperates with a farebox.
Figure 6:
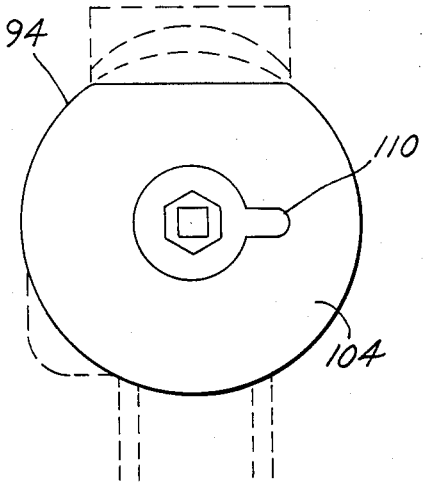
FIG. 6 is a partial cross sectional view of lock assembly incorporated in the cashbox which cooperates with the cover of the present invention to lock and unlock the cover.

The interior of cashbox 10, as illustrated in FIG. 3, is divided into two chambers 30 and 32 by a chamber divider or interior wall 34. Chamber 30 receives currency from farebox 16 (shown in FIG. 1), into which cashbox 10 is placed, and chamber 32 receives coins. The currency and coins are separated from each other by a mechanism in the farebox 16 and directed into the proper chamber 30, 32. Divider 34 supports an interlock reflector 36, held in place in a channel 38 on the top of wall 34 by rivets 40.

The receptacle also includes a heavy duty cover 12 which is slidably and pivotably attached to the top of the cashbox 10. That is the cover 12 includes a front edge, downwardly depending flange 44 extending from a top cover plate 46. A handle assembly is attached to the flange 44. The handle assembly includes a handle 48 attached to a shaft 50 journaled through an opening 51 at the center of the flange 44. The shaft 50 is retained in the opening 51 by bushings 52, 54 so that the handle 48 and shaft 50 may rotate freely.

The shaft 50 projects and slides through a keyed passage 56 in pivot block 58 attached to the top front edge of wall 26. Block 58 is thus mounted to pivot about an axis transverse to the shaft 50 and parallel to the top edge of wall 26. In this manner, the entire cover 12 may be pivoted about the pivot axis of block 58 to enclose or reveal the open top of cashbox 10. The shaft 50 also slides in passage 56. Thus the entire cover 12 can slide with respect to the top edge of wall 26 and also pivots with respect to the top edge of wall 26. The cover 12, however, remains attached to the cashbox 10 by the cooperative action of the shaft 50 and pivoting block 58. Note that the shaft 50 includes a lateral rib 82 that must be aligned with a slot 85 of passage 56 in order for shaft 50 to freely slide in passage 56.

The cover 12 also includes a tab 60 projecting forwardly from the side opposite flange 44. That is, a tab 60 is welded to the inside surface of cover plate 46 and slides under a planar top flange 62 extending from back wall 24. Flange 62 lies on the same plane as cover plate 46 and thus acts as a stop for plate 46. Tab 60 prevents pivotal motion of cover 12 when the cover 12 is in the closed position.

The cover 12 overlays the side walls 20, 22 and is retained in alignment with respect to the side walls 20, 22 by depending side flanges 64, 66 respectively. Each side flange 64, 66 includes an end slot 68, 70 respectively which cooperates with a tab 72, 74 respectively to further prevent pivotal motion of the cover 12 when cover 12 is in the closed position.

The cover 12 includes a mechanical arrangement mounted on the inside surface for locking the cover 12 in position and for controlling the sliding movement of shaft 50 in block 58. Specifically a telescoped tube 78 is slidably mounted on shaft 50 and includes a longitudinal slot 80 extending partially from one end that is cooperative with the rib 82 projecting from shaft 50. In this manner rotation of shaft 50 is imparted to tube 78 even though shaft 50 and tube 78 are moved telescopically with respect to each other. The tube 78 includes an end post 84 projecting through an opening 86 in a depending arm 87 of slide bracket 88. Post 84 is connected to an actuator arm 90 which has a projecting drive pin 92. Pin 92 cooperates with a lock mechanism 94 described in further detail below mounted on the back wall 24. This total mechanical locking arrangement is positioned to fit in the channel 38 separating chambers 30, 32.

Slide bracket 88 is an L shaped bracket attached to the inside cover plate 46 by headed studs 96, 98, 100 projecting from cover plate 46. Each stud 96, 98, 100 fits through a longitudinal slot 97, 99, 101 respectively. Slots 97, 99, 101 extend longitudinally in the direction of shaft 50. The slots 97, 99, 101 effectively limit the travel of bracket 88. More importantly the sliding movement of bracket 88 when the cover 12 is in the closed position is defined by the end of tube 78 which engages the bushing 52 that retains shaft 50. This insures that the pin 92 will be in proper position to operate the lock mechanism 94.

Figure 1:
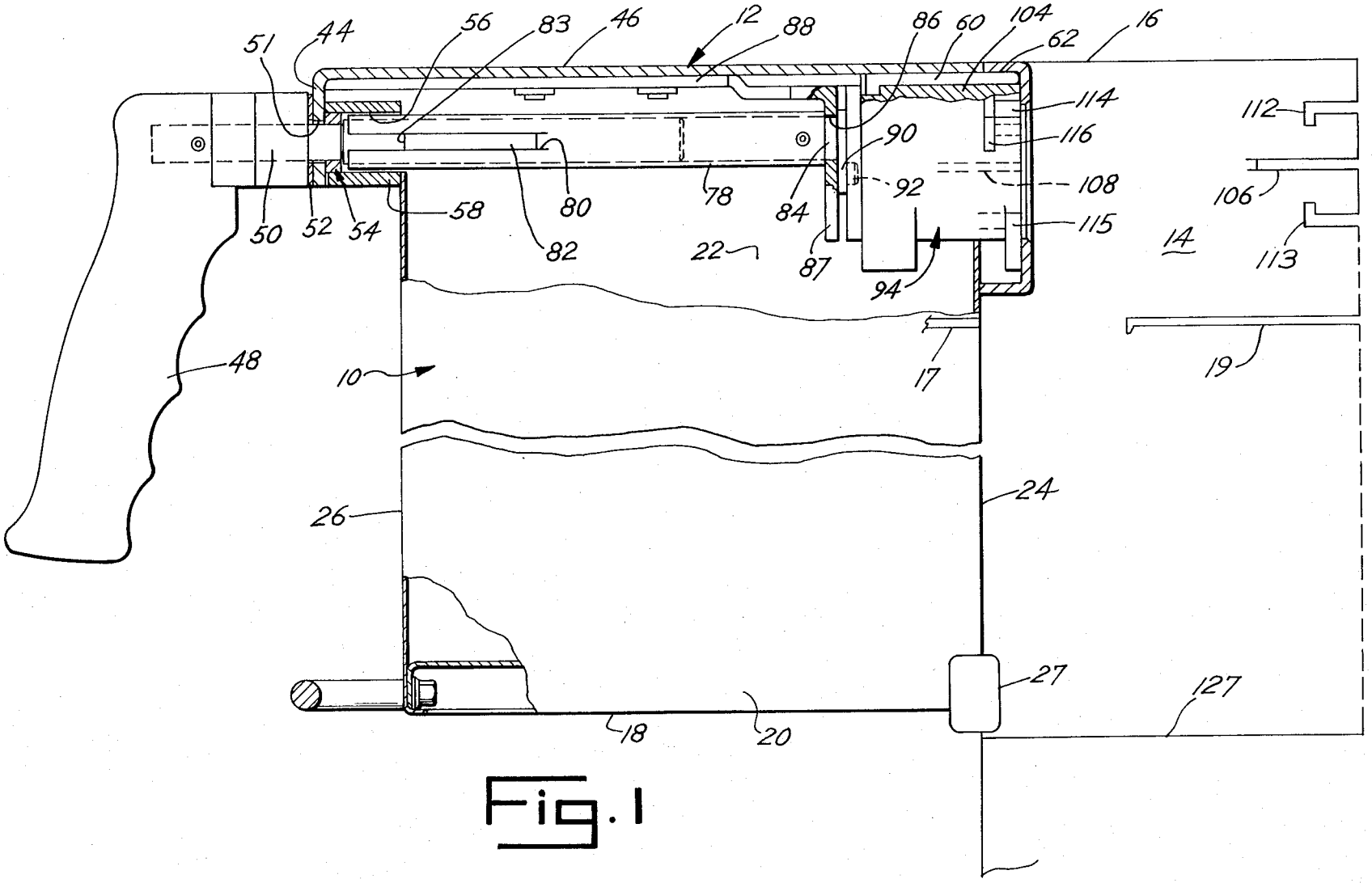
FIG. 1 is a partial cross sectional side view of the cash collection receptacle of the present invention.
Figure 2:
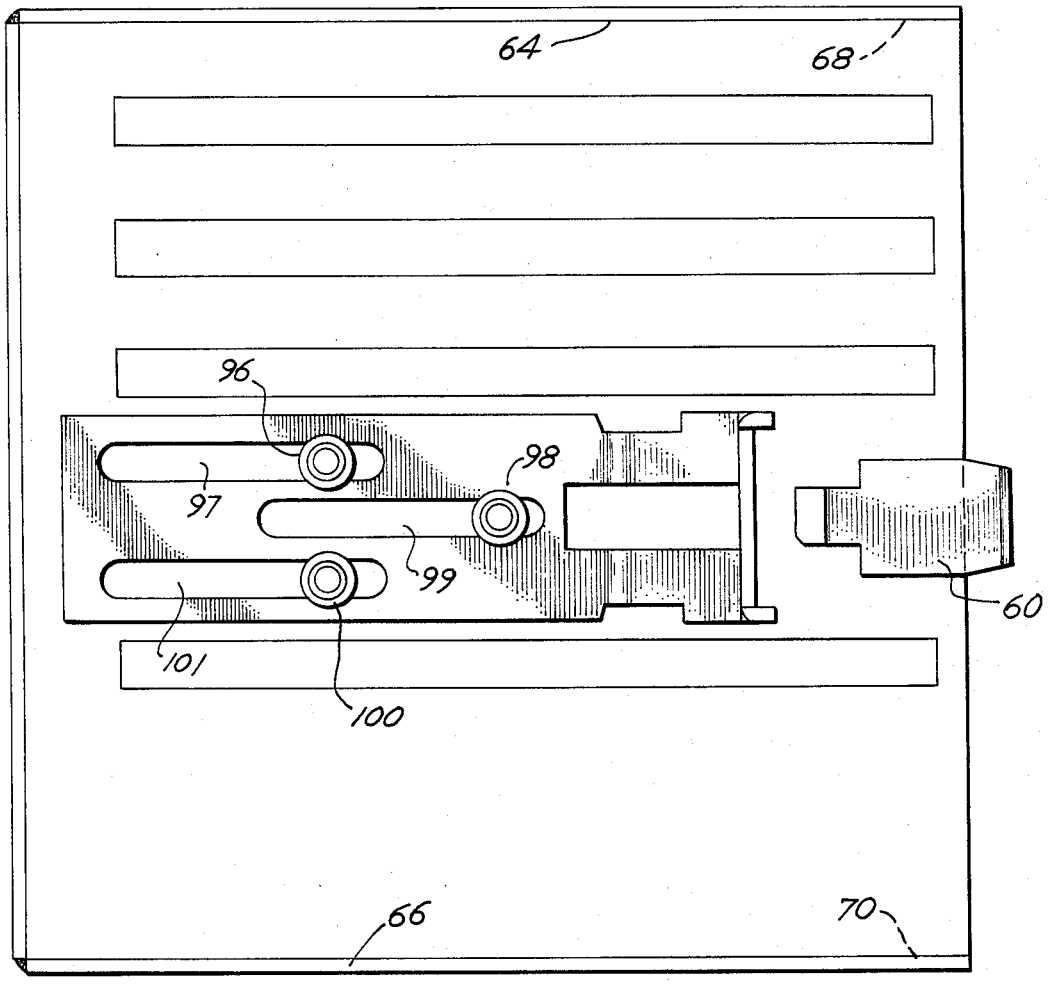
FIG. 2 is a bottom plan view of the slidable cover of the cash collection receptacle.

When the cover 12 is in the open position, the bracket 88 may slide to the right in FIG. 1 until the tab 60 engages and prevents further sliding of the bracket 88. Alternatively, the slots 97, 99, 101 will limit travel of bracket 88. In this manner, the arm 87 of bracket 88 limits the sliding movement of cover 12 as cover 12 slides from the closed to the open position and permits complete sliding movement of cover 12 to expose the entire inside of the cashbox 10. Note if bracket 88 were not slidable, the cover 12 could only be partially opened. Sliding bracket 88 thus permits total opening of cover 12.

The lock mechanism 94 is affixed to the rear wall 24 and includes a key operated lock with a rotatable barrel 104 that, when unlocked by a key, e.g. key 106, may be driven by drive pin 92 engaging detent 110. A proper key 106 must, however, be inserted into the lock mechanism 94. Thus, a key member 106 which projects from the opening or cavity 14 in the farebox 16 is aligned to engage the keyhole 108 of lock mechanism 94. When key 106 is inserted into keyhole 108, the lock mechanism releases rotatable barrel 104 and permits rotation thereof. Barrel 104 projects through the mechanism 94 and includes an inner end detent or slot 110 comperative with drive pin 92. Thus pin 92 can effect rotation of barrel 104 only when the cover 12 is totally closed. However, such rotation is only possible when a key 106 is inserted in keyhole 108.

When the key 106 is positioned in hole 108, opposed depending tabs 112, 113, also affixed to farebox 16 on opposite sides of key 106, will fit into longitudinal slots 114, 115 in barrel 104. The slots 114, 115 connect to a circumferential groove 116 in the barrel 104. By rotating the barrel 104 when tabs 112, 113 have been inserted through slots 114, 115 and positioned in groove 116, the cashbox 10 becomes locked in the cavity 14 of the farebox 16. Cooperation of tabs 112, 113 with groove 116 prevent removal of the cashbox 10 from farebox 16 until the tabs 112, 113 are again aligned with slots 114, 115. Such alignment is possible only when the barrel 104 and handle 48 are oriented properly. When in such an orientation, the handle 48 is preferably aligned vertically or in a 6 o'clock position as shown in FIG. 1. Thus, when handle 48 is in the 6 o'clock position and cover 12 is closed, the cashbox 10 may be inserted or removed from cavity 14. Also, when aligned in this vertical orientation, the rib 82 is sized so that the back edge 83 of the rib 82 will engage the block 58 and prevent withdrawal of the shaft 50 through the block 58. The cover 12 is thus locked in a closed position.

Pivoting the shaft 50 to the 3 o'clock position will align the rib 82 with the slot 85 in passage 56. By such a pivoting action, simultaneously the tube 78 is rotated to rotate the pin 92 and lock the lock mechanism 94. That is, the barrel 104 is rotated to a position where tabs 112, 113 are not aligned with the slots 114, 115 and thus cannot be released from groove 116. Thus, the cashbox is locked in cavity 14 and the cover 12 can slide from the closed to the open position only when the handle 48 is in the horizontal or 3 o'clock orientation. To remove the cashbox 10, the cover 12 must be locked over the top of the cashbox 10. Of course, after removal of the cashbox 10 from cavity 14, the cover 12 must remain closed because handle 48 is locked in position by lock mechanism 94 since key 106 has been removed.

On one side of pivot block 50 is a coin scraper member 120 and on the other side a currency scraper member 122 which are spring loaded by compression springs 124, 126, respectively. Scrapers 120, 122 are compressed tightly against the cover plate 46 to retain all of the coins and paper currency in the cashbox 10 upon sliding movement of cover 12.

In operation, the cashbox 10 is quite simple to use. The cashbox 10 is lifted by the aluminum control handle 48 and the leading edge of bumper 27 is placed on the floor 127 of the opening or cavity 14 of pedestal of a farebox 16, such as the CENTSABIL TM farebox manufactured by General Farebox Incorporated of Chicago, Ill. The cashbox 10 is pushed towards the rear of the cavity 14, which causes reinforced side rails 17 of cashbox 10 to engage support rails 19 in the pedestal thereby lifting the bottom wall 18 of the cashbox 10 off of the floor 127 of the pedestal cavity 14.

Continued pushing of the cashbox 10 towards the rear of the pedestal will cause the key 106, mounted on the rear wall of the pedestal to enter the lock assembly 94 of the cashbox 10. Annular groove 116 is located in the lock assembly 94 for the purpose of retaining the cashbox 10 in the pedestal when cover 12 is opened. The two diametrically opposed tabs or pins 112, 113 located within the key housing engage groove 116 through the two access slots 114, 115, which are aligned with the pins 112, 113 only when the cashbox 10 is locked. When the cashbox 10 is fully seated in the cavity 14, the key 106 releases the lock mechanism permitting rotation of barrel 104 and the cashbox 10 is unlocked by rotating the control handle 48.

Control handle 48 is thus rotated 90° in a counterclockwise direction from the 6 o'clock position to the 3 o'clock position. This causes the tabs 112, 113 in the cavity 14 to be captured in the lock assembly groove 116, which prohibits separation of the cashbox 10 from the cavity 14. The cover 12 is also released and ready to be opened. The control handle 48 is then pulled, thereby pulling the cover 12 out until it is fully withdrawn from the cashbox 10. The withdrawn cover 12 is then pivoted downward about pivot block 58 until the cover 12 contacts the front wall of the cashbox 10.

The cashbox 10 is now fully opened and ready to receive revenue and may be removed from the cavity 14 only by closing and locking the cover 12 which is effected by grasping the control handle 48 and lifting the cover 12 to the horizontal position. While horizontal, the cover 12 is pushed forward until it is fully closed. The control handle 48 may not be rotated during approximately the last two inches of travel. This restriction is to prohibit rotation of the barrel 104 before the cover 12 is in position to be captured by the lock assembly 94. This is accomplished by the configuration of the keyway 85 for the shaft 50 in pivot block 58.

When the cover 12 is fully closed, the control handle is rotated 90° clockwise to the 6 o'clock position from the 3 o'clock position, thereby rotating the barrel 104, and releasing the tabs 112, 113 in the key housing from the groove in the lock assembly. The cashbox 10 and closed cover 12 are then removed from cavity 14. The handle 48 cannot be rotated because key 106 has been removed. The handle 48 cannot withdraw cover 12 since rib edge 83 of rib 82 engages block 58 and prevents sliding movement of the shaft 50. Rib 82 is thus not aligned with slot 85 when handle 48 is in the 6 o'clock position.

Emptying of the contents of the cashbox 10 is accomplished by inserting the cashbox 10 in an inverted manner into a revenue receiver apparatus (not shown). When the cashbox 10 is so inverted, all of the contents lie against the underside of the cover. A key may then be inserted in keyhole 108 to permit release of cover 12 by rotating handle 48 and sliding cover 12. The scrapers 120, 122 are provided to ensure complete and proper evacuation of the collected revenues when the cover 12 is pulled out from the cashbox 10.

It should be understood that the foregoing disclosure emphasizes certain specific embodiments of the present invention and that all modifications or alternatives equivalent thereto are within the spirit or scope of the invention as set forth in the appended claims.

What is claimed is:

1. A collection receptacle for receiving cash from a farebox comprising in combination:

(a) a cashbox having an open top;

(b) a cover, said cover being pivotably attached to said cashbox at one edge of the top side of said cashbox and slidable with respect to the pivotal attachment to cover said top, said cover including means for interlocking with said cashbox when said cover is in the closed position to prevent pivotal movement of said cover in the closed position;

(c) a control handle attached to said cover, said handle being rotatable to two positions, one position preventing sliding and pivotable movement of said cover when said cover is in the closed position and the other position permitting sliding and pivotal movement of said cover between the closed position and an open position, said handle including a shaft projecting therefrom and journaled through the cover; and (d) a keyway member pivotally attached to the cashbox, said shaft slidably projecting through a key passage in the keyway member, a portion of said shaft including a key member cooperative with the opening to permit sliding movement of the shaft in the block only when the handle is oriented in a single position.

2. A collection receptacle as in claim 1 wherein said cashbox has a plurality of separate interior compartments, said compartments adapted to receive separate items.

3. A collection receptacle as in claim 2 wherein said cashbox has scraping means mounted therein cooperatively engaging the cover when the cover is in the closed position for retaining coins and currency in the cashbox as the cover is slidably removed.

4. A collection receptacle as in claim 1 wherein said means for interlocking said cover with said cashbox comprises a cooperative member on the cover for engaging a complementary member affixed to the cash box.

5. The mechanism of claim 1 including a lock actuating mechanism attached to the shaft and a lock mechanism mounted in the cashbox in alignment with the lock actuating mechanism when the shaft is keyed to slide in the keyway member.

6. The mechanism of claim 1 including a lock mechanism mounted in the cashbox in alignment with a lock actuating mechanism attached to the shaft; said lock mechanism including means for interlocking the cashbox with the receptacle and means for actuating the lock mechanism.

7. A collection receptacle for receiving cash from a farebox comprising in combination:

(a) a cashbox having an open top;

(b) a cover, said cover being pivotably attached to said cashbox at one edge of the top side of said cashbox and slidable with respect to the pivotal attachment to cover said top, said cover including means for interlocking with said cashbox when said cover is in the closed position to prevent pivotal movement of said cover in the closed position; and (c) a lock assembly, said lock assembly disposed on said top side of said cashbox on the side opposite said edge about which said cover is pivotably attached, said lock assembly having a front portion and a rear portion, said front portion being adapted to cooperate with said cover in the closed position for operation of the lock assembly and said rear portion cooperative with a key mechanism disposed in said farebox to retain said cashbox in said farebox.

8. A collection receptacle as in claim 7 wherein said farebox includes a chamber for receipt of the cashbox and said key mechanism is mounted in said chamber, said key mechanism including a key for actuation of the lock assembly and also including pin members, said pin members being receivable in an annular groove of said rear portion of said lock assembly thereby maintaining said cashbox in said chamber when said cashbox is unlocked.

9. A collection receptacle as in claim 7 wherein said cover has tabs on each side thereof, said tabs adapted to interlock with tabs on the sides of said cashbox when said cover is in said closed position.

10. A collection receptacle as in claim 7 wherein said cover has a tab thereunder, said tab being adapted to cooperate with a flange on said cashbox when said cover is in said closed position.

11. In a collection receptacle for receiving cash from a farebox comprising in combination:

(a) a cashbox having an open top;

(b) a cover, said cover being pivotably attached to said cashbox at one edge of the top side of said cashbox and slidable with respect to the pivotal attachment to cover said top, said cover including means for interlocking with said cashbox when said cover is in the closed position to prevent pivotal movement of said cover in the closed position;

(c) a control handle attached to said cover, said handle being rotatable to two positions, one position preventing sliding and pivotal movement of said cover when said cover is in the closed position and the other position permitting sliding and pivotal movement of said cover between the closed position and an open position; and (d) a lock assembly, said lock assembly disposed on said top side of said cashbox on the side opposite said edge about which said cover is pivotably attached, said lock assembly having a front portion and a rear portion, said front portion being adapted to cooperate with said cover in the closed position for operation of the lock assembly and said rear portion cooperative with a key mechanism disposed in said farebox to retain said cashbox in said farebox.

* * * * *